United States Patent [19]

Moore

[11] 4,022,434

[45] May 10, 1977

[54] TIRE FENCE

[76] Inventor: Phil D. Moore, P.O. Box 309, The Dalles, Oreg. 97058

[22] Filed: Feb. 9, 1976

[21] Appl. No.: 656,369

[52] U.S. Cl. ..... 256/1; 61/3; 61/4; 404/6

[51] Int. Cl.[2] ..... E01F 13/00

[58] Field of Search ..... 61/3, 4, 5, 37; 256/1, 256/2, 64; 404/6

[56] References Cited

UNITED STATES PATENTS

| | | | |
|---|---|---|---|
| 3,276,210 | 10/1966 | Stitt | 61/5 |
| 3,475,009 | 10/1969 | Brown | 256/64 |
| 3,848,853 | 11/1974 | Way et al. | 256/1 |
| 3,928,701 | 12/1975 | Roehner | 61/4 |
| 3,934,540 | 1/1976 | Bruner et al. | 404/6 |
| 3,951,384 | 4/1976 | Hildreth, Jr. | 256/1 |

*Primary Examiner*—Andrew V. Kundrat
*Attorney, Agent, or Firm*—Eugene D. Farley

[57] ABSTRACT

A tire fence comprises a plurality of pneumatic tire casings arranged in the superimposed courses and fastened to each other by bolts or other suitable fasteners. The bottom portion of the lowermost course is stabilized by being buried in the ground.

9 Claims, 4 Drawing Figures

TIRE FENCE

BACKGROUND AND BRIEF STATEMENT OF THE INVENTION

This invention relates to fences made from discarded tire casings.

Although conventional barbwire and electric fences are employed to enclose countless square miles of land, their use is attended by serious disadvantages well known to every farmer and rancher.

The original cost of the fencing materials is very high. Metal fence posts rust and wood fence posts rot. The fences require constant policing and constant expensive maintenance. They are subject to damage by snow, sleet and ice. Stock can reach through them to graze forbidden areas. Stock animals are prone to crowd and press against the fence posts and/or wires, which ultimately yield, whereby the fence is destroyed.

Thus on the one hand farmers and ranchers are plagued with fences which are costly and possess serious disadvantages. On the other hand society is plagued with a superabundance of waste pneumatic tire casings.

It is the general purpose of the present invention to cancel out the one disadvantage with the other with attendant economic benefit to all concerned.

In particular, it is the general object of the present invention to provide a fence adapted for wide scale farm and range application and made entirely from discarded pneumatic tire casings.

Such a fence has many and significant advantages:

It is of low cost, the tire casing raw materials having no economic value whatsoever. It possesses great strength — more than adequate to withstand crowding and pushing by range cattle and other stock. It is quickly and cheaply erected with a minimum of labor, using tools and fasteners readily available to the farmer.

It is not subject to rot nor to damage by the elements and hence has an indefinite service life. It can be looked through to observe events transpiring on the other side. It is stable against force exerted in any direction. It is paintable for improved appearance. If an electric fence, it is self-insulating. It does not require corner posts.

It is of especial interest that the tire fence of my invention possesses an inherent resiliency which makes it of particular value in confining stock. When cattle, horses or other heavy animals lean against it, it is not rigid and inflexible, as are fence posts and fencing wire. To the contrary, it is resiliently yielding, bending with the applied force and returning to its original position when the force is withdrawn.

This is both strange and distasteful to farm and range animals, partly because they are accustomed to the stability of conventional fences and partly because of an instinctive apprehension induced by the yielding qualities of the fence. As a result, the animals shun the fence and do not subject it to stresses which otherwise might damage it.

All of these advantages are obtained by the provision of a fence made from discarded tire casings — a commodity available in unlimited amount and worse than valueless since it presents a costly disposal problem. My invention thus has important ecological benefits.

The tire fence of my invention broadly comprises a plurality of pneumatic tire casings arranged in contiguous relation in a plurality of superimposed substantially coplanar courses. Trench or other supporting means support the bottom course in substantially vertical position. Fastening means such as bolts fasten the contiguous casings to each other. One or more wires are strung along the fence and fastened thereto by suitable fasteners such as ring type fasteners.

The courses preferably are arranged in staggered relation to achieve planar continuity of the fence. Half casings are positioned to square off the end portions of the staggered courses. Buttressing tires are placed at selected intervals the length of the fence, arranged at right angles to the fence and bearing agaist the component casings thereof for increasing fence stability.

DESCRIPTION OF PREFERRED EMBODIMENTS OF THE INVENTION

The tire fence of my invention is described with reference to the accompanying drawings wherein.

Figure 1:
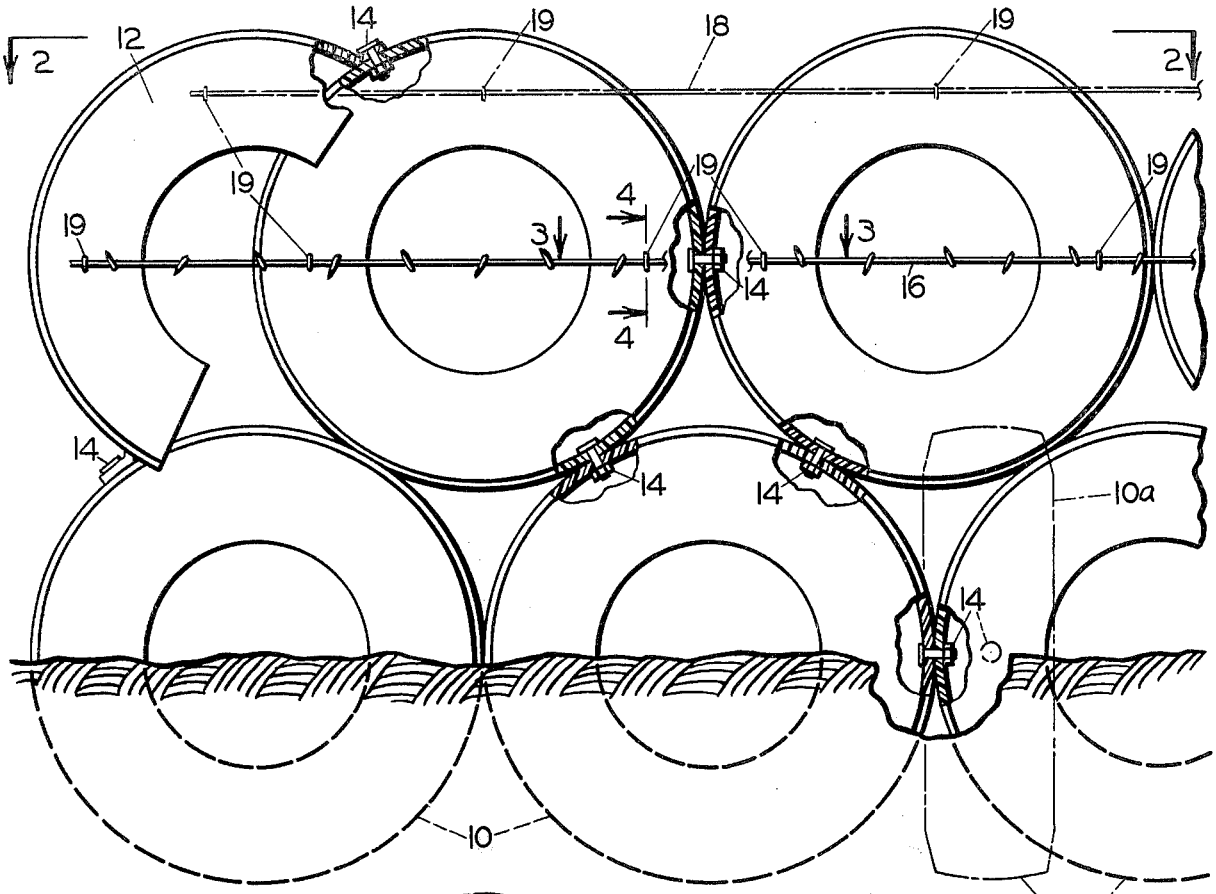
FIG. 1 is a fragmentary elevation view of the fence, with parts broken away and in section better to show interior construction.
Figure 4:
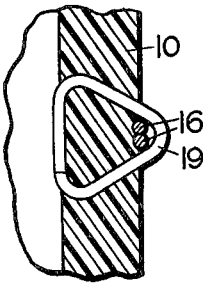
Figure 3:
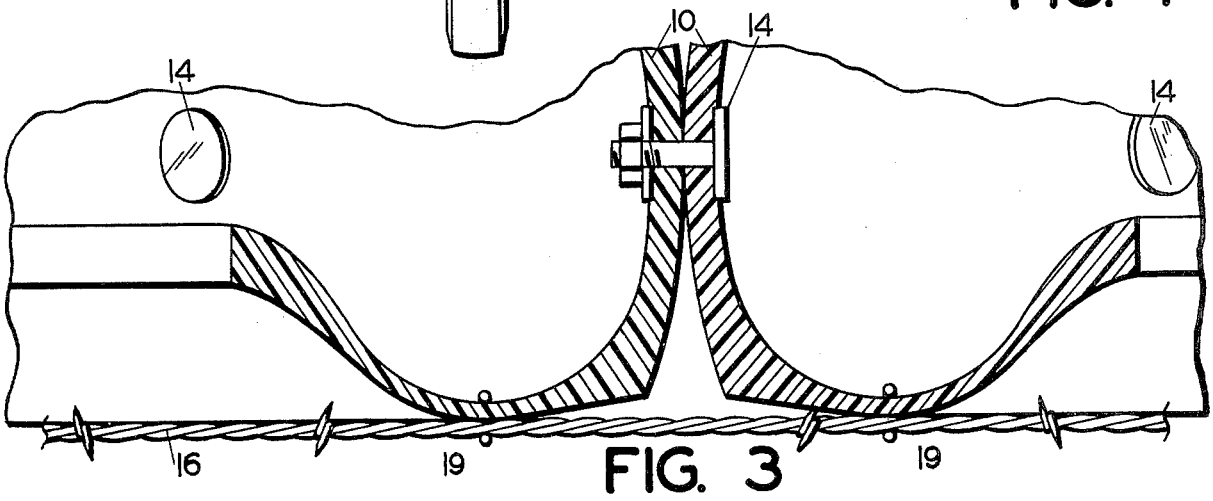

FIGS. 3 and 4 are fragmentary, detail sectional views taken along lines 3—3 and 4—4, respectively of FIG. 1.

As noted above, the hereindescribed tire fence basically comprises a large number of tire casings arranged in superimposed coplanar courses with their contiguous portions held together by fasteners.

The tire casings employed comprise discarded casings available at no cost in unlimited quantities. Particularly desirable are large truck casings because of their inherent size and strength. The tire casings may be in any condition and require no special pretreatment to be suitable for my purpose.

As is particularly apparent in FIG. 1, the lowermost course of casings 10 are suitably supported, preferably by being placed in trenches to a depth equal to at least about one-third, preferably about one-half, the height of the casings. This is easily accomplished by trenching the fence line, placing the tires in the trench in a vertical position, and then filling in the trench. The settling of the soil, abetted by the action of rain and surface water, will pack the soil around the casings, rigidly and permanently embedding them.

The casings placed in the trench are arranged vertically in contiguous abutting relation to each other, with the tops of all casings being at substantially the same height i.e. on the same vertical plane.

Another row or course of casings is superimposed on the lowermost row. For planar continuity of the fence, the second course of casings preferably is staggered or offset from the first course longitudinally of the fence so that the individual casings of the upper course nest between the casings of the lower course.

The upper course casings also are arranged vertically in contiguous relation not only to the lowermost casings but also to each other, with all lying in substantially the same vertical plane. The tops of the upper course of casings all lie on a substantially straight horizontal line.

Figure 2:
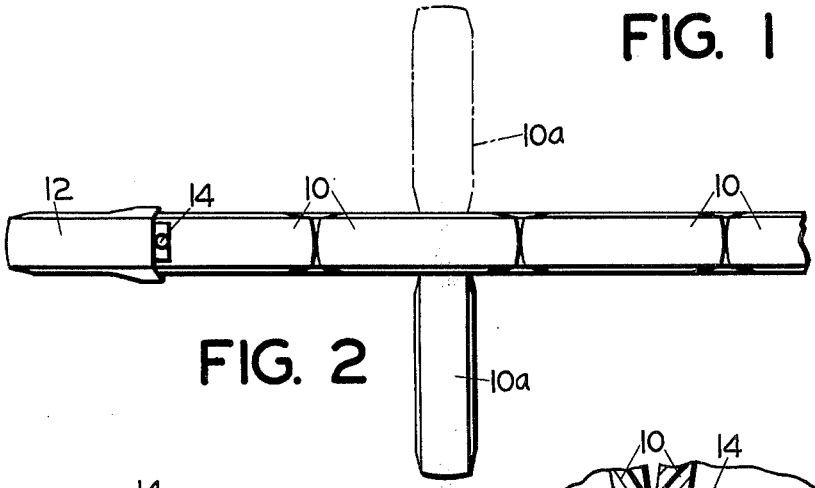
FIG. 2 is a fragmentary plan view of the fence.

A half casing 12 is placed in each of the vacant areas caused by the staggered arrangement of the upper and lower courses. A plurality of full casings **10*a*** are arranged at right angles to the fence, as shown particularly in FIG. 2, with their surfaces bearing against the adjacent casings for imparting added stability to the fence.

Fastening means are provided for fastening the casings of each course to each other as well as to the casings of contiguous course. Spur type fasteners are preferred for this purpose, i.e. fasteners which penetrate openings formed through adjacent casings and interlock the penetrated casing portions.

In the illustrated form of the invention, nut, bolt and washer assemblies 14 are employed for this purpose. Belt bolts are particularly suitable because of their wide flat heads which will not pull through the tough casings.

The bolts may be simply applied by means of tools readily available to the farmer. Thus the hog farmer may employ a conventional hog hook, which is contoured and dimensioned exactly as required, to perforate the adjacent casing walls. He then may slip the bolt through the perforations thus provided and tighten it down in the usual manner.

One or more additional courses may be superimposed on the second course, depending upon the height and size of the tires used and the weight of the fence desired.

The fence assembly may be complemented by the provision of one or more runs of fence wire.

Thus in the illustrated form of the invention there is provided a run of barbwire 16 supported on the upper course of casings and a run of electric wire 18 a spaced distance above. It is noted that the tire supports serve inherently as insulators for the electric wire because of their non-conductive qualities.

Fastening means are provided for fastening both the barbwire and the electric wire to the casings. Again fastening means and a fastening tool are employed which are readily available to the average farmer and rancher.

Illustrated particularly in FIG. 4, the fasteners used for securing the barbwire run to the casings comprise ordinary hog rings 19. They may be applied easily by means of a hog ringing tool in the illustrated manner, with the ring penetrating the substance of the casing, for example the bead area or a corner of the tread, and capturing the barbwire strand.

The fence accordingly may be constructed, rapidly and relatively easily using a small crew of men and employing basically nothing but scrap tire casings. The trench is dug, the lower course of casings placed in position, the trench filled, the lower course casings bolted together, the upper course casings superimposed and stapled to the lower course casings and the wire strung and fixed in place. End pieces 12 and buttress casings 10*a* are applied as required. No corner or terminal of fence posts at all are needed.

The fence thus constructed is effective in retaining stock and, except for the remote possibility of fire, indestructible either by the stock, or by action of the elements. The required maintenance thus is kept at an absolute minimum.

Having thus described my invention in preferred embodiments, I claim:

1. A tire fence comprising a. a plurality of pneumatic tire casings disposed vertically in a single vertical plane with their axes extending normal to said plane and with their axes aligned in common planes while being also located in spaced parallel planes and staggered vertically with each other and also arranged in contiguous relation with each other to provide a plurality of superimposed substantially coplanar courses, b. supporting means supporting the bottom course in substantially vertical position, and c. casing fastening means in said vertical plane fastening the contiguous casings to each other.

2. The tire fence of claim 1 wherein the supporting means comprises trench means receiving the lowermost portions of the casings comprising the lowermost course.

3. The tire fence of claim 1 wherein the casing fastening means comprise stud means penetrating and securing together the walls of contiguous casings.

4. The tire fence of claim 3 wherein the stud means comprise nut and bolt means.

5. A tire fence comprising a. a plurality of pneumatic tire casings arranged in contiguous relation in a plurality of superimposed substantially coplanar courses, b. trench means supporting the bottom course in substantially vertical position, c. bolt fastening means penetrating and securing together the walls of adjacent casings, d. at least one wire strung the length of the fence at a selected vertical distance from the ground, and e. hog ring wire fastening means fastening the wire to the casings.

6. A tire fence comprising:

a. a plurality of pneumatic tire casings arranged in contiguous relation in a plurality of superimposed substantially coplanar courses, the casings of each course being arranged in longitudinally staggered relation to the casings of the course immediately adjacent, b. half casings positioned to square off the ends of the staggered courses, c. supporting means supporting the bottom course in substantially vertical position, and d. casing fastening means fastening the contiguous casings to each other.

7. A tire fence comprising:

a. a plurality of pneumatic tire casings arranged in contiguous relation in a plurality of superimposed substantially coplanar courses, b. supporting means supporting the bottom course in substantially vertical position, c. casing fastening means fastening the contiguous casings to each other, and d. at least one wire strung along the fence at a predetermined elevation and wire fastening means securing the wire to the casings.

8. A tire fence comprising:

a. a plurality of pneumatic tire casings arranged in contiguous relation in a plurality of superimposed substantially coplanar courses, b. supporting means supporting the bottom course in substantially vertical position, c. casing fastening means fastening the contiguous casings to each other, and d. tire casings positioned at selected intervals along the length of the fence and arranged substantially at right angles thereto, the casings being secured to the ground and bearing against the fence in a direction substantially normal thereto for buttressing the same.

9. The tire fence of claim 7 wherein the wire fastening means comprise closed hog rings penetrating the casings and enclosing the wire.

* * * * *